US005878604A

United States Patent [19]

Stone et al.

[11] Patent Number: 5,878,604

[45] Date of Patent: Mar. 9, 1999

[54] PROTECTION DEVICE FOR BOLT SEAL AND HASP

[75] Inventors: Robert E. Stone, Upland; Terrence N. Brammall; David L. Stevenson, both of Angola; Craig Hamilton, Waterloo, all of Ind.

[73] Assignee: Transguard Industries, Angola, Ind.

[21] Appl. No.: 909,247

[22] Filed: Aug. 11, 1997

[51] Int. Cl.[6] ..... E05B 67/38

[52] U.S. Cl. ..... 70/56; 70/417; 70/DIG. 43; 70/DIG. 56; 292/148; 292/205; 292/327

[58] Field of Search ..... 70/54–56, 417, 70/DIG. 43, DIG. 56; 292/148, 205, 327

[56] References Cited

U.S. PATENT DOCUMENTS

| | | | |
|---|---|---|---|
| 3,736,016 | 5/1973 | Garvey et al. | 70/56 X |
| 3,751,948 | 8/1973 | Klein | 70/55 |
| 3,828,591 | 8/1974 | Beaver | 70/56 |
| 3,951,443 | 4/1976 | Barnaby | 292/327 |
| 4,033,155 | 7/1977 | De Lucia | 70/56 |
| 4,068,505 | 1/1978 | Volk, Jr. | 70/56 |
| 4,096,718 | 6/1978 | Michelman et al. | 70/417 X |
| 4,106,315 | 8/1978 | Dohanyos | 70/56 |
| 4,458,510 | 7/1984 | Nielsen | 70/56 X |
| 4,626,009 | 12/1986 | Burnett et al. | 292/327 |
| 4,781,043 | 11/1988 | Loeffler | 70/54 |
| 4,882,918 | 11/1989 | Stanich | 70/56 X |
| 4,898,008 | 2/1990 | Eberly | 70/56 |
| 4,905,486 | 3/1990 | Appelbaum | 70/55 X |
| 4,972,689 | 11/1990 | Anderson | 70/56 |
| 5,092,143 | 3/1992 | Rumbles | 70/56 |
| 5,118,149 | 6/1992 | Emmons | 292/327 |
| 5,146,771 | 9/1992 | Loughlin | 70/56 |
| 5,219,384 | 6/1993 | Elsfelder et al. | 70/56 X |
| 5,261,258 | 11/1993 | Bunger | 70/56 |
| 5,347,689 | 9/1994 | Georgopoulos | 24/136 R |
| 5,413,393 | 5/1995 | Georgopoulos et al. | 292/327 |
| 5,477,710 | 12/1995 | Stafanutti | 70/56 |
| 5,743,118 | 4/1998 | Anderson | 70/417 X |

FOREIGN PATENT DOCUMENTS

| | | | |
|---|---|---|---|
| 2277123 | 10/1994 | United Kingdom | 292/148 |

*Primary Examiner*—Lloyd A. Gall
*Attorney, Agent, or Firm*—William Squire

[57] ABSTRACT

A plurality of walls form a housing cavity in which a latch hasp is received. An opening in the housing receives therethrough the latch hasp, the latch enclosing the cavity. The bolt seal has a shank with a head at one end or with a U-shaped bight in a second embodiment. The head engages a housing wall and a locking body engages and locks to the shank at a shank end distal the head. The shank between the head and lock body is fully enclosed by the housing and latch to preclude access to the shank by tampering tools. In a second embodiment, the shank bight engages the received hasp of a latch. The shank distal the bight is locked to the housing by a locking body. The latch depends into and encloses the housing cavity open at the top. The shank between the bight and the locking body is fully enclosed in the cavity. Different housings are disclosed wherein the head may be enclosed or exposed for access by a shank breaking tool. A reusable bolt and locking body is disclosed for use with several embodiments.

17 Claims, 3 Drawing Sheets

FIG. 1
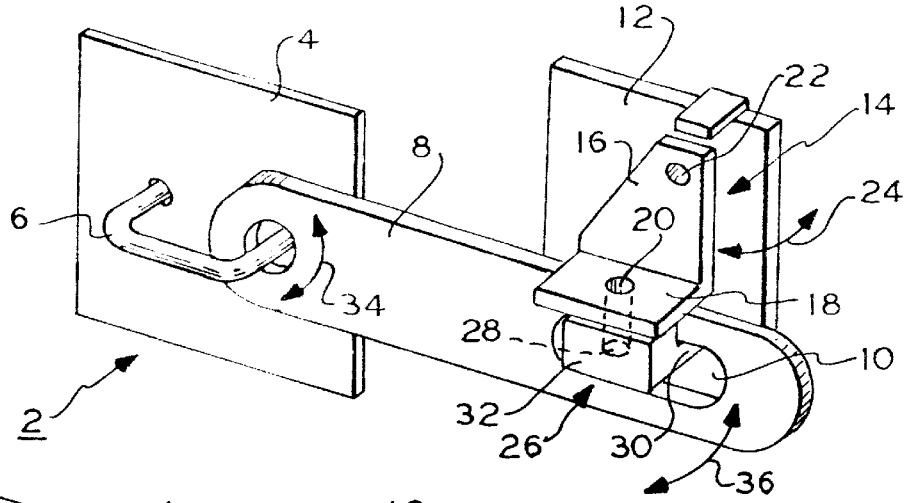
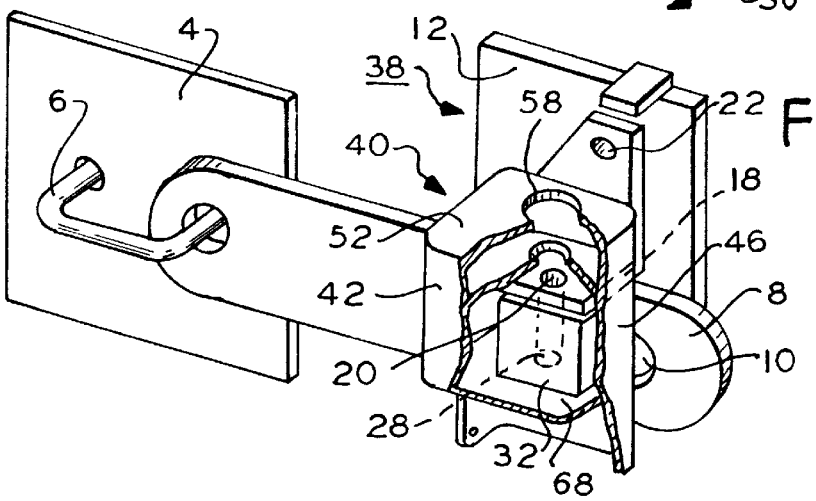
FIG. 2
FIG. 3
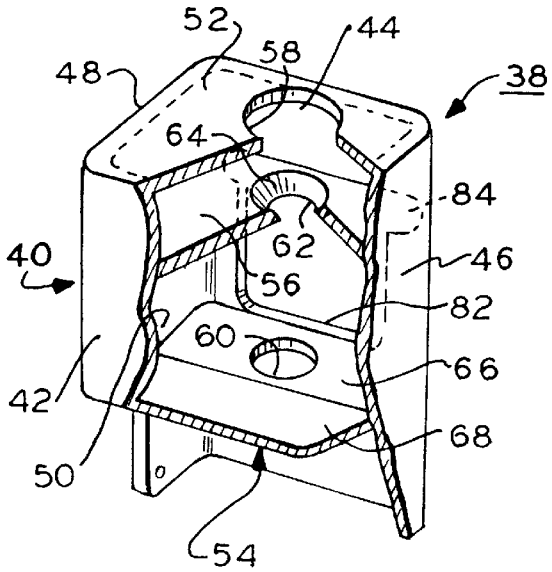
FIG. 4
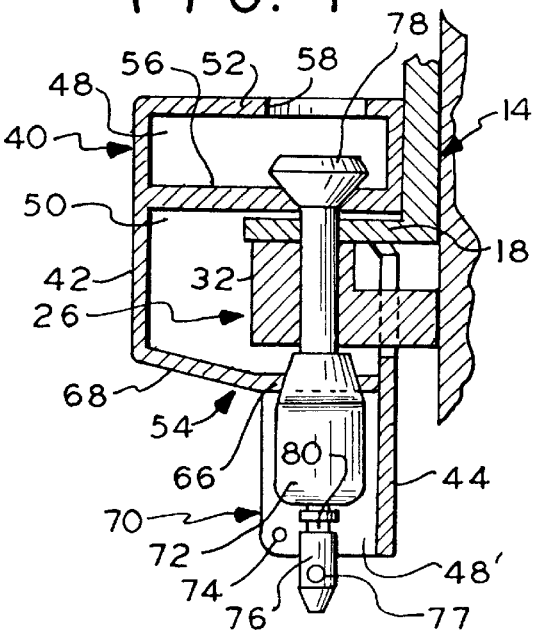

PROTECTION DEVICE FOR BOLT SEAL AND HASP

This invention relates to bolt seal protectors, and more particularly, to a protector for rail car door latch hasps and the like secured by bolt seals.

Of interest are commonly owned U.S. Pat. Nos. 5,413,393 and 5,347,689, both in the name of Georgopoulos et al. and U.S. Pat. No. 5,732,989 in the name of David L. Stevenson et al., all incorporated by reference herein.

Cargo shipping vehicles and containers, and in particular, rail cars, especially those shipping automobiles, are subject to widespread tampering due to the value of the cargo. Thieves break open conventional bolt seals which comprise a steel bolt shank to which a head is swaged at one end and to which a locking body containing a lock mechanism is locked at the other end. The shanks are subject to relatively easy tampering by way of bolt cutters or cutting torches. The problem is aggravated by the fact that different rail cars, for example, may employ different types of latches and hasps.

U.S. Pat. No. 5,413,393 illustrates a bolt seal and a tool for breaking the shank at the head end of the shank. The tool engages the head and manually bends the shank which breaks due to serrations in the shank. In the aforementioned U.S. Pat. No. 5,732,989, a locking seal employs a steel bolt with a head at one end and grooves along the bolt shank for use with a locking body containing a releasable locking mechanism which engage the grooves. The mechanism is released by a disclosed mating specially designed tool and which locking body mechanism is otherwise difficult to release and is relatively tamper resistant. U.S. Pat. No. 5,347,689 shows a further bolt seal configuration using a bolt and locking body and which requires a tool similar to the tool of the '393 patent tool to break the seal shank. Other seals are known wherein tool cutters are required to cut the bolt shank.

In U.S. Pat. No. 5,118,149, a container hasp protector is disclosed. A metal box-like body has a top plate, a bottom plate, right and left side plates, an open rear face and a front face. A shield plate is on the front face and extends between the side plates forming a top opening in the face between the shield plate and top plate and a bottom opening in the face between the shield plate and the bottom plate. The body is arranged to protect the hasp from intentional breakage.

The shield plate has an aperture which cooperates with aligned apertures in a hasp to receive a breakaway security seal. The problem with this device as recognized by the present inventors is that while the hasp is protected, the shank of the seal is exposed via the openings in the front face. These openings are provide so that an authorized user can break the seal by cutting the shank. The problem is that the exposed shank permits tamperers to use bolt cutters or torches to readily cut the seal shank.

The present inventors recognize that potential thieves do not like to tamper with locks that are difficult to open, especially locks on cargo doors which may be subject to periodic surveillance. If the locks can not be opened in a few minutes, thieves are likely to pass up such tampering. For this reason the device of the '149 patent is believed not desirable for valuable cargo containers and the like.

U.S. Pat. No. 3,951,443 discloses a security lock that employs a locking pin. The lock employs interengaged keepers with aligned through apertures which receive the pin. One of the keepers has a through pilot hole in the face thereof so that the pin can be cut apart with a heavy duty power drill for use by an authorized person. The only way for the lock to be opened is by destroying the pin. This is not satisfactory because the locking pin is destroyed rather than capable of reuse. More importantly, it is disclosed that thieves would not like to use a noisy, inconvenient and conspicuous power drill. However, portable cutting torches may also be used to cut the pin via the pilot hole. This is believed unsatisfactory.

Padlock protector devices are disclosed in U.S. Pat. Nos. 4,898,008, 4,033,155, 5,146,771, and 5,477,710. These also are not satisfactory for cargo shipping containers or rail cars because the shackles are readily exposed for destruction by a tamperer. Further these devices are not disclosed as operative with bolt seals of the type described above.

The present inventors recognize a need for a cost effective seal and latch protection device which uses cost effective reusable locking bodies or reusable bolts and locking bodies. They recognize a need for a protection device which precludes access to the bolt shank which is vulnerable to tampering.

A device according to one aspect of the present invention protects a hasp and a bolt seal wherein the seal comprises a shank, a locking head means and a locking body, the hasp having an aperture for receiving the shank in a lock mode. The device comprises a housing defining a cavity, the housing having an opening for receiving the hasp in the cavity, the hasp for enclosing the opening to preclude access by tampering tools therethrough.

At least one member is secured to the housing and has an aperture in communication with the cavity for receiving the shank, the locking head means and locking body for locking the shank to the at least one member and to the hasp, the cavity being sufficiently enclosed by the housing, at least one member and hasp to preclude access to the shank in the lock mode by tampering tools.

A protection device according to a further aspect of the present invention is latch hasp and bolt seal wherein the hasp has at least one aperture and the seal comprises 1) a shank having opposing ends, the shank for passing through the at least one aperture, 2) locking means for precluding passage of one shank end in a locked state through the at least one aperture and 3) a locking body selectively locked to the shank at an opposing shank end for locking the hasp therebetween.

The device comprises a housing including a plurality of side walls defining a cavity having a bottom, a top and a plurality of sides, the housing having an opening for receiving the hasp in the cavity, the side walls for enclosing the cavity at the sides, the latch for enclosing the opening to preclude access to the cavity through the opening with tampering tools.

At least one plate member is provided for enclosing at least the bottom such that the side walls, the at least one plate member and the latch cooperate to enclose the cavity to preclude tampering access to the cavity and received shank by the tampering tools, the at least one plate member having a first aperture cooperating with the received at least one hasp aperture for receiving the shank therethrough, the locking means and locking body for locking the received hasp to the at least one plate member whereby the shank and received hasp between the locking means and the locking body are enclosed to preclude access to the shank by the tampering tools.

In a further aspect the opening is in one of the side walls, the housing having a further plate member for enclosing the top, the further plate member having a second aperture aligned with the first aperture and the received at least one hasp aperture for receiving the shank.

In a still further aspect the locking means comprises a head secured to the shank, the device including a third plate member in the cavity intermediate the at least one and further plate members for further enclosing and dividing the cavity, the third plate member having a third aperture aligned with the first and second apertures and for alignment with the received at least one hasp aperture, the third aperture for receiving the shank therethrough, the second aperture being enlarged relative to the third aperture for receiving the head therethrough so that the received head is intermediate the third and further plate members.

The shank in a further aspect is formed with a U-shaped portion having a bight between the one end and the opposing end, the hasp at least one aperture is for receiving the bight, the one bight and locking body for cooperating to lock the hasp to the at least one plate member.

IN THE DRAWING

FIG. 1 is an isometric view of a bi-level and tri-level automobile rail car latch and hasp assembly;

FIG. 2 is a partially in section isometric view of the latch of FIG. 1 assembled with a seal and hasp protection device according to one embodiment of the present invention without a locking bolt seal;

FIG. 3 is an isometric view partially in section showing in greater detail the protection device of FIG. 2 without the latch;

FIG. 4 is a side elevation sectional view of the device of FIG. 2 attached to the latch hasp of FIG. 1 with a locking bolt seal attached to the bolt shank and hasp in the locked mode;

Figure 5:
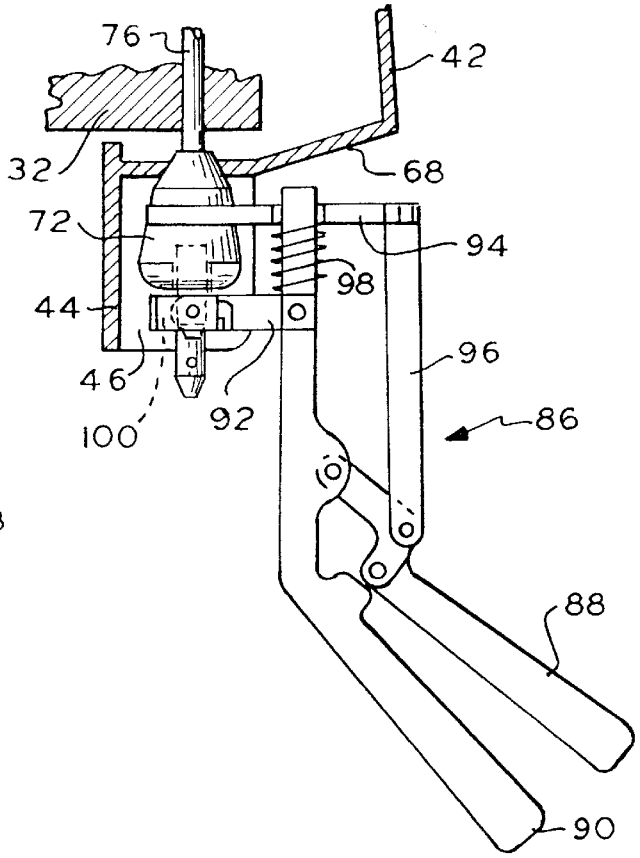
FIG. 5 is a side elevation view partially in section similar to FIG. 4 and partially fragmented showing a tool in place for releasing the locking body from the shank of the locking bolt of the device of FIG. 4.

In FIG. 1, latch 2 is a conventional existing assembly for securing two opposing doors of automobile carrying rail cars which may be bi-level or tri-level. Latch 2 comprises a sheet metal plate member 4 secured to one rail car door (not shown) and a staple 6 secured to the plate member 4. An elongated sheet metal latch member 8 has a hole through which is loosely attached staple 6 and has a slot 10 at the end distal the staple 6. A second sheet metal plate member 12 is secured to the other rail car door (not shown).

A hasp assembly 14 comprises a first L-shaped hasp 16 having a leg 18 with an aperture 20. Hasp 16 pivots at pin 22 in directions 24. A second L-shaped hasp 26 is fixed to plate member 12. Hasp 26 leg 32 has an aperture 28 alignable with the aperture 20 of movable hasp 14. Legs 18, 30 and 32 form a channel which receives the member 8 adjacent to the slot 10, hasp 26 passing through the slot 10. The member 8 is movable in directions 34 and 36 to engage and disengage the hasp 26 after the hasp 16 is rotated in directions 24.

Seal protection device 38, FIG. 2, comprises a box-like casing or housing 40 preferably fabricated of 5/16 inch thick sheet steel plate members preferably welded together. While discrete plate members are shown, curved or rounded walls without discrete boundaries may also be used. The housing 40 has a front plate member wall 42, a rear plate member wall 44, and two opposing lateral side plate member walls 46, 48. The walls may be formed of a single sheet bent as shown and then preferably butt welded medially side wall 46. The walls 40, 42, 44 and 46 define a cavity 50 having a plurality of sides, a top and a bottom. The cavity top is enclosed with a top plate member wall 52 and the cavity bottom is enclosed with a bottom plate member wall 54. An intermediate wall 56 is in the cavity 50 dividing the cavity 50 into two subchambers.

The walls 52, 54 and 56 are preferably welded to the casing 40. The top wall 52 has a circular hole 58 next adjacent to wall 44. The bottom wall 54 has a circular hole 60. Wall 56 has a circular hole 62 which has a beveled edge 64. The holes 58, 60 and 62 are preferably axially aligned. Wall 54 has a rear section 66 and a front section 68. The rear section 66 is normal to all of the casing 40 walls. The front section 68 is normal to the side walls but inclined relative to the rear and front walls as best seen in FIG. 4. The rear wall 44 depends beyond the bottom wall 54 as do side walls 46 and 48.

The depending portions are coextensive with and abut bottom wall rear section 66. The depending portions form a protective region about the bolt seal 70, and in particular, about the locking body 72 containing the locking mechanism (not shown). A depending side wall 48' has a hole 74 for receiving a tamper evidencing seal (not shown).

The seal 70 is preferably releasable as more fully described in the aforementioned U.S. Pat. No. 5,732, 989 incorporated by reference herein. In the alternative, the seal may be of other configurations which may be commercially available or of the type described in the commonly owned patents described in the introductory portion.

The seal 70 preferably comprises a circular steel shank 76 to which is swaged a locking head 78 having a frusto-conical portion tapering toward the shank 76. The frusto-conical portion mates with and nests within and against the beveled edge 64 of hole 62 in the intermediate wall 56. The head 78 has a diameter smaller than the top wall 52 hole 58 to pass therethrough. The head 78 is located in the chamber defined by walls 52 and 56. The shank 76 adjacent the other end has an axial array of annular grooves 80 which mate with the locking mechanism (not shown) of locking body 72, which mechanism is fully described in the aforementioned U.S. Pat. No. 5,732,989. The shank 76 has an aperture 77 therethrough for receiving a tamper indicating seal (not shown) which is engaged also with hole 74.

The locking body 72 maybe formed of a hardened steel casing to resist tampering and has a tapered outer surface. The smaller end of the casing is smaller than the hole 60 of bottom wall 54 so as to partially engage this hole to preclude tampering with the shank whose exposed portion between the head 78 and locking body 72 is entirely within cavity 50 between the walls 56 and 54.

The locking body mechanism has jaws (not shown) that are releasably engaged with any of the shank grooves 80. This permits the locking body 70 to enter into the hole 60 in the locked state. The locking jaws permit the body 70 to slide along the shank toward the head 78 while locked against displacement in the opposite direction unless released.

Rear wall 44 has a substantially square opening 82 except for an enlarged transverse region 84. The opening 82 receives the hasp 26 (FIG. 2) and the enlarged region 84 receives the leg 18 of the hasp 16 as best seen in FIG. 4. The received hasp apertures 20 and 28 are aligned with the holes 58, 60 and 62 of the device 38.

In operation, the bolt seal 70 shank is passed through all of the aligned apertures, with the head nested in hole 62. The locking body 72 is then attached to the shank until it seats in the hole 60 and against the bottom wall 54. The latch hasps enclose the opening 82 in the rear wall and support the device 38. As a result the shank 76 between the head 78 and seal locking body 72 is fully enclosed and inaccessible by tampering tools external the casing 40.

To release the locking body 72, FIG. 5, a tool 86, as more fully described in the aforementioned U.S. Pat. No. 5,732,989, is employed. The tool 86 has a pair of squeezable handles 88, 90. A jaw 92 is secured to handle 90. A second jaw 94 is pivotally secured to handle 88 via link 96. A compression spring 98 is between the jaws. A cylinder 100 is pivotally attached to jaw 92. The cylinder 100 engages the locking body 72 internal locking mechanism employing a spring. This spring (not shown) has a high spring constant, e.g., requiring several hundred pounds force to displace. This spring keeps the locking body jaw mechanism locked. The tool 86 by manually squeezing the handles together exerts a highly leveraged force against the jaw mechanism spring to displace and unlock these jaws. The locking mechanism spring is relatively tamper resistant due to its high spring load.

The depending side wall portions such as portion 48' preclude bolt cutters from accessing the exposed locking body. The recessed head 78 is also not accessible to bolt cutters. Further, cutting torches will most likely melt and fuse the head or locking body to the casing and at best will take considerable time to free the latch of the device 38. Such increased tampering time serves as a deterrent to thieves who disdain lengthy tampering due to potential periodic surveillance. The inclination of bottom wall section 68 provides clearance access for the tool 86. The tool 86 can access the locking body 72 through the open one side of the casing 40 at the depending walls 48' which preclude easy access by more conventional tools.

Figure 7:
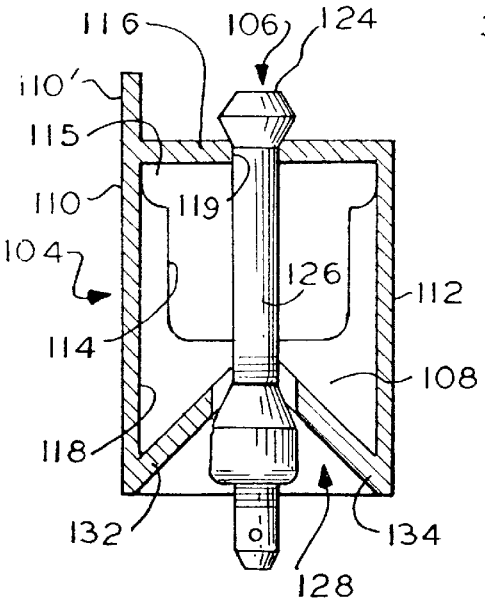
FIG. 7 is an side elevation sectional view of the device of FIG. 6 with a bolt seal and without a latch attached.
Figure 6:
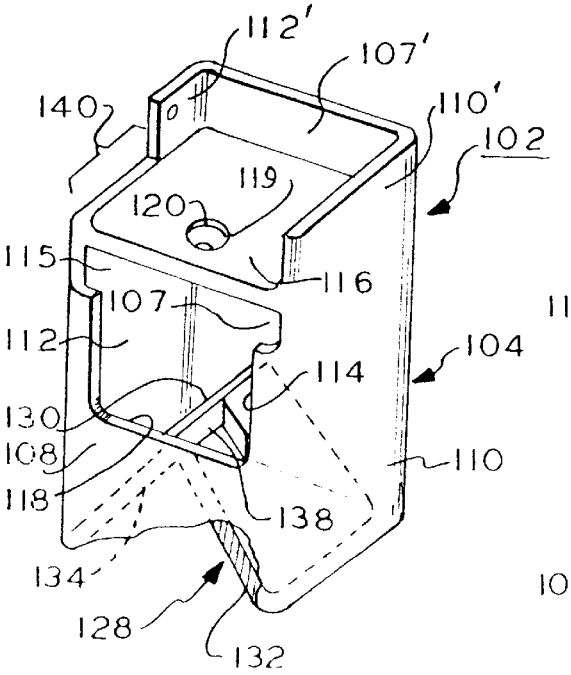
FIG. 6 is a partially in section isometric view of a protection device according to a second embodiment of the present invention for use with the latch of FIG. 1.
Figure 8:
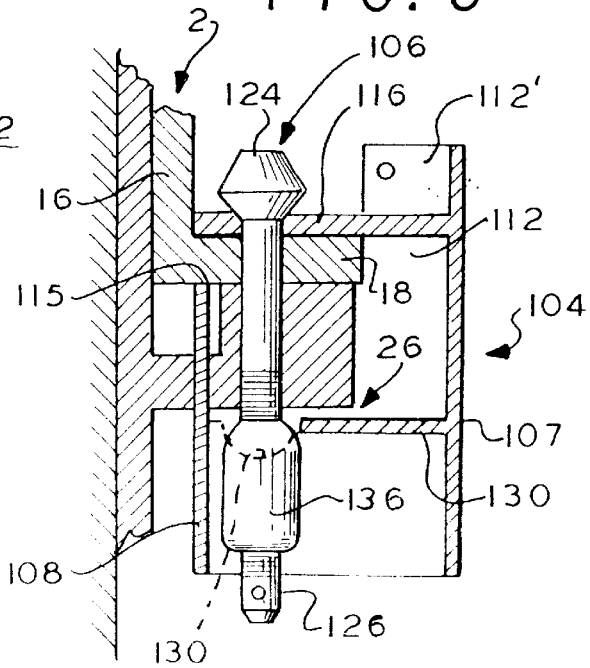
FIG. 8 is a side elevation sectional view of the device of FIG. 7 attached to the latch hasp of FIG. 1.

FIGS. 6, 7 and 8 illustrate a second embodiment comprising a protection device 102 having a housing 104 for use with a breakaway seal 106 of the type disclosed in the aforementioned U.S. Pat. Nos. 5,347,689 and 5,413,393. Housing 104 is made of sheet steel plate members similar to the housing 40 of FIG. 3, and is used with the latch 2, FIG. 1. The housing 104 has a front wall 107, a rear wall 108 and opposing lateral side walls 110 and 112. The rear wall 108 has an opening 114 identical to the opening 82 and a region 115 identical to region 84 of the housing 40, FIG. 2 for receiving the hasps 16 and 26.

A top wall 116 encloses cavity 118 at the top thereof. Top wall 116 has a hole 119 with a beveled edge 120. The edge 120 mates with and engages the received frusto-conical portion of seal 106 head 124. The seal 106 shank 126 is partially surrounded by top wall 116 with no portion exposed above the top wall 116.

Bottom wall 128 is formed of a right angle iron. The apex 130 of the wall 128 is interior the space between the front, rear and side walls closest to the top wall 116. The bottom wall 128 has two inclined sections 132 and 134 each secured to and terminating distal the apex 130 at a different respective side wall 110, 112, A lock body 136 on the seal 106 is partially received in a hole 138 in the bottom wall through the apex 130 and is adjacent to the rear wall 108. The walls are preferably joined by welds.

The bolt seal lock body 136 includes a locking collet (not shown) that slides up the seal 106 shank 126 in a one way clutch action. The collect engages the grooves 140 in locking engagement as described in the aforementioned patents '689 and '393. This permits a portion of the lock body casing to enter into the cavity 118 so that the shank 126 is located fully within the cavity.

To open the seal requires the head to be grasped by a breaking tool as described in patent '393. The shank is then bent and broken by the tool. The locking body, however is reusable, and the shank discarded. The shank has no externally exposed portions outside the housing 104, the shank being the most vulnerable component in the bolt seal.

To protect the locking body 136, the bottom wall 128 forms a V-shaped recess with the front and rear walls which surround the locking body. This precludes accessing the body 136 from the sides with tampering tools. The access is only from the bottom direction which makes it more difficult to tamper with the locking body 136.

The head 124 is protected and shielded on three sides by upwardly extending respective portions 107', 110' and 112' of the front wall 107, and side walls 110 and 112. The front wall portion 107' and side wall portion 110' extend for their entire transverse extent beyond the top wall 116, FIG. 6. The side wall portion 112' extends upwardly beyond the top wall slightly less than one half of the wall 112 width from the rear to front wall to form an open region 140 above top wall 116 at the housing side. The open region above top wall 116 and the opening 114 in the rear wall 108 is shielded by the latch 2 (FIG. 1) which precludes access to the head 124 from the rear of device 102. The only side access to the head is via the open region 140 in to permit use of the seal breaking tool (not shown). Tampering tool access to the head is minimized by the upward extending portions 107', 110' and 112' and to the lock body 136 by the surrounding bottom and side walls. Torch access to the head and lock body requires undesirable excessive time to defeat the locked seal.

Figure 9:
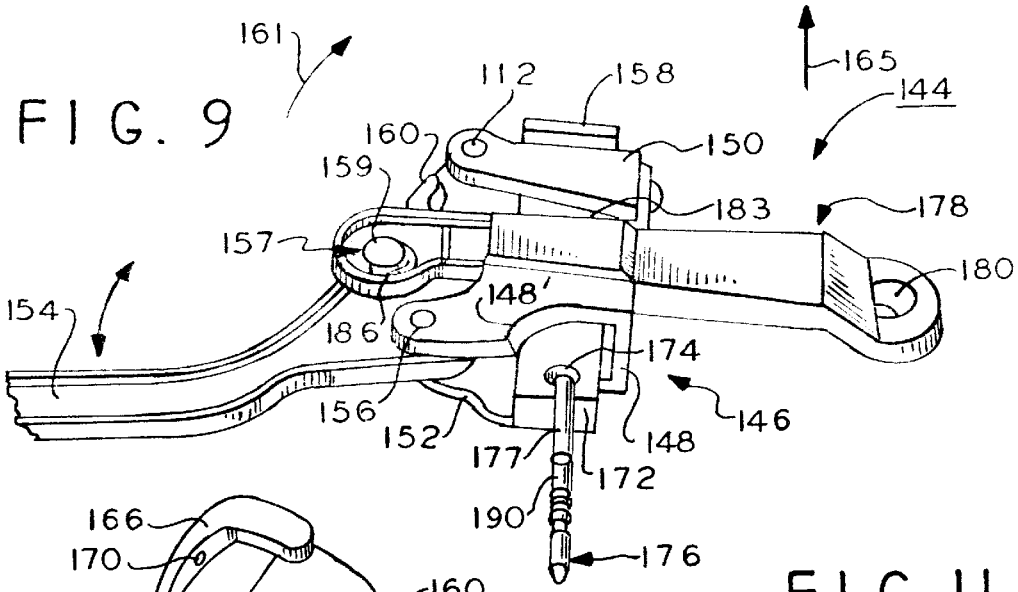
FIG. 9 is an isometric view of a latch and hasp assembly employed with box rail cars sliding doors including a bolt shank in place for use with the protection device according to a third embodidment of the present invention.
Figure 10:
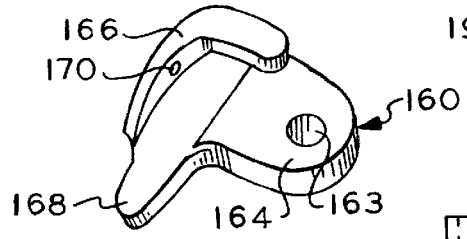
FIG. 10 is an isometric view of a component used on the latch assembly of FIG. 9.
Figure 11:
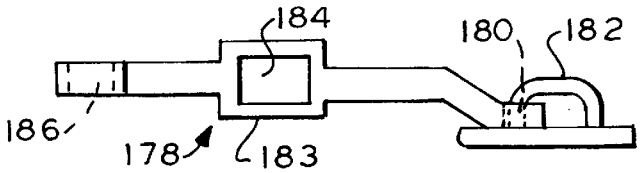
FIG. 11 is a side elevation view of a further component of the latch assembly of FIG. 9.
Figure 12:
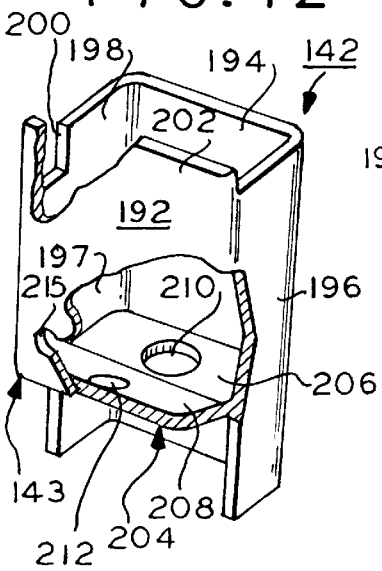
FIG. 12 is a partially in section isometric view of a protection device according to a third embodiment of the present invention for use with the latch of FIG. 9.
Figure 13:
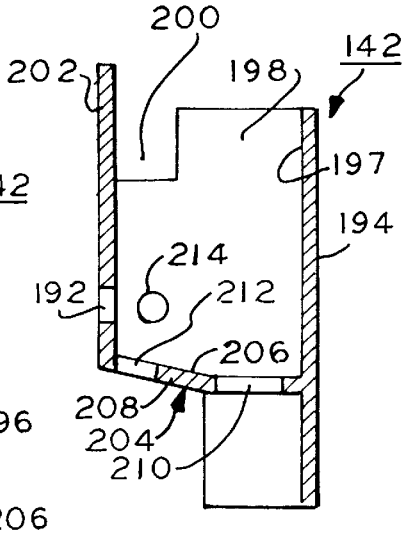
FIG. 13 is a side elevation view partially in section of the protection device of FIG. 12.
Figure 14:
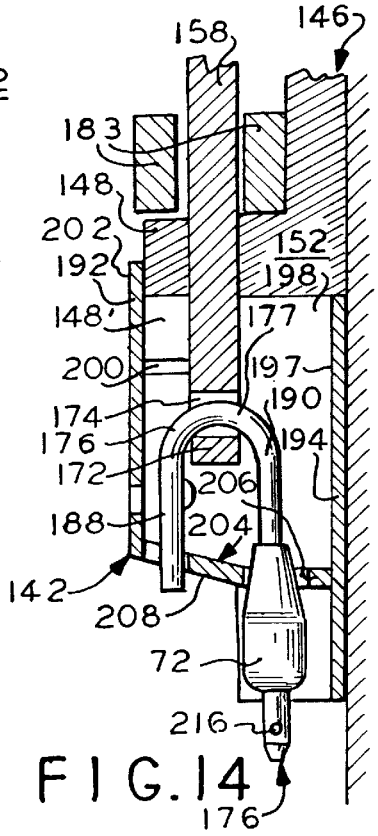
FIG. 14 is a side elevation sectional view of the device of FIG. 12 attached to the latch hasp of FIG. 9 in the locked mode with a locking bolt seal in place.

A third embodiment of a bolt seal protective device 142 is shown in FIGS. 12–14 for use with a rail box car latch 144, FIGS. 9–11. The latch 144 is used on sliding doors of box cars. The latch 144 comprises a yoke member 146 which typically is cast iron as are all of the components of the latch 144. The yoke member 146 comprises a pair of yokes 148, 150 secured by a common plate member 152. A handle 154 is pivoted to yoke 148 by pin 156. A stud 157 with an enlarged head 159 upstands from a side of the handle 154. A wedge hasp 158 locking member 160 is pivoted to yoke 150 by pin 162.

In FIG. 10, locking member 160 comprises a body 164 pinned by pin 162 via hole 163, an upstanding L-shaped rib 166 and a tongue 168. A tamper indicating seal (not shown) receiving hole 170 is in rib 166. The rib 166 and hole 170 are adjacent to the handle 154 when the wedge hasp 158 is in the locked state of FIG. 9.

The wedge hasp 158 tapers somewhat to end 172, which end forms a hasp. The end 172 has a hole 174 for receiving a locking bolt 176 of the present invention, or as in the prior art, for receiving the shackle of a padlock (not shown) or a conventional bolt seal shank of the representative type shown in the '393 patent for example. The hasp 158 is passed through the yokes 148 and 150 in the locking state. In this locked state, the locking member 160 is pivoted to the position shown in FIG. 9 with the tongue 168 engaged with a recess (not shown) in a side of the wedge hasp 158.

In the unlocked state, the locking member 160 is pivoted in direction 161 about pin 162 to disengage tongue 168 from the wedge hasp recess. The wedge hasp 158 is then free to be disengaged from the yokes 148 and 150 in direction 163. All of the above described structure of the latch 144 is secured to the side of a box car stationary wall.

A sliding door securing bar 178, FIG. 11, is cast iron and elongated. The bar 178 has an aperture 180 at one end for receiving a staple 182 secured to the box car door (not shown), the staple movably locking the bar 178 to the door. The bar 178 has a somewhat centrally located enlarged portion 183 with a rectangular opening 184 which receives therethrough the wedge hasp 158, FIG. 9, in the locked state. The end of the bar 178 distal staple 182 has an aperture 186 for receiving the stud 157. The handle 154 has a seal receiving opening (not shown) to receive the tamper indicating seal which is engaged with the hole 170 of the locking member 160 in the locked state. Prior art bolt seals locked to the hasp hole 174 are easily defeated by thieves because the shanks are exposed for breakage.

The handle 154 pivots about pin 156 to cam the door shut with the locking member 160 in the unlocked state. The locking member 160 is then pivoted to the locking state of FIG. 9.

The protection device 142 according to this embodiment employs bolt 176, which has a 180° bight 177, FIG. 14. The bight 177 sits within the hole 174 of the wedge hasp 158 (FIG. 9). The bolt 176 has a short shank portion 188 and a long shank portion 190. The long portion 190 has an axial array of circular grooves the same as grooves 80 in shank 76, FIG. 4. These grooves are for releasable locking engagement with locking body 72 described above and in U.S. Pat. No. '989.

The protection device 142, FIGS. 12 and 13, comprises a housing 143 including a front plate member wall 192, a rear plate member wall 194 and two opposing lateral side walls 196, 198. These walls form a cavity 197 having four sides, a top and a bottom. The side wall 198 has a notch 200. The front wall 192 has a top portion 202 that extends toward the top of the device 142 higher than the side and rear walls. The cavity 197 bottom is enclosed by bottom wall 204.

Bottom wall 204 is formed with a rear plate member section 206 normal to all of the walls and a front plate member section 208 normal to the side walls and inclined to the front and rear walls. The rear section 206 has an aperture 210 for receiving a portion of the locking body 72 and the bolt 176 long bolt portion 190. The front section 208 has an aperture 212 for receiving the bolt 176 short portion 188. In similar fashion to the device 38, FIG. 3, the rear and side walls depend below the bottom wall 204 to form a U-shaped protective region for the locking body 72. A portion of the locking body 72 enters and engages the aperture 210 in the locked state.

In operation, the bolt 176 is first inserted in the wedge hasp hole 174 as shown in FIG. 9 after the latch 144 is placed in the locked state of FIG. 9. The device 142 cavity 197 is open at the top for receiving the latch 144 wedge hasp 158. The yoke 148 abuts the upper portion 202 of the front wall and overlies and encloses the open top of the cavity 197. The yoke 148 has a leg 148' which engages and encloses the notch 200.

A tamper indicating seal (not shown) is engaged with hole 216 in bolt 176, FIG. 14. The latch 144 fully encloses the bolt 176 in the region at the bight 186 to the locking body 72, precluding access to tampering to the bolt to break the bolt open. While the bolt shank portion 188 is exposed through the bottom wall 204, this portion is harmless with respect to breaking the bolt 176 by tampering.

The bolt locking means in the claims corresponds to the bight 186 in this embodiment as compared to the bolt heads 78 and 124 in the other embodiments described hereinabove. As in the embodiment of FIG. 4, the bolt locking means is enclosed to preclude tampering. In the embodiment of FIG. 14, the bolt locking means, i.e., the bight, is fully enclosed. In the embodiment of FIG. 4, the bolt head locking means is partially enclosed due to the presence of hole 58. Tests on rail cars exhibiting 10% breaking and entering with prior art bolt seals exhibited no breakage of the seals on rail cars sealed with the device 142.

The illustrated embodiments are for illustration and not limitation. It will occur to those of ordinary skill that various modifications may be made to the disclosed embodiments without departing from the scope of the invention defined by the appended claims. For example, steel plate members are illustrated but other high strength materials may be used. By way of further example, the device need not have defined separate sides as shown but may be curved which curves inherently include sides and walls as claimed.

What is claimed is:

1. A protection device for a bolt seal having a shank, a head and a locking body and for a latch hasp having a pair of alignable apertures for receiving the seal shank comprising:

a housing having a cavity and comprising front and rear walls, a pair of opposing lateral side walls, a top plate member and a bottom plate member, said rear wall having an opening for receiving said hasp, said received hasp for enclosing said opening, said walls and plate members for enclosing said cavity to preclude access by tampering tools to the hasp and to the shank in said cavity, said top and bottom plate members each having an aperture for receiving said shank between said head and locking body, said bolt seal for securing the hasp to and between said top and bottom plate members;

a further plate member overlying the top plate member and secured to all said walls for forming an enclosed chamber therebetween, the further plate member having an aperture for passing the received head and shank therethrough, said top plate member aperture for passing only said shank therethrough so that the head in the received secured state is between the top and further plate members.

2. Protection device for a latch hasp and bolt seal, the hasp having at least one aperture, the combination comprising:

a seal comprising 1) a shank having opposing ends, said shank for passing through said at least one aperture, 2) locking means for precluding passage of one shank end in a locked state through said at least one aperture and 3) a locking body selectively locked to the shank at an opposing shank end for locking the hasp therebetween;

a housing including a plurality of side walls defining a cavity having a bottom, a top and a plurality of sides, said housing having an opening for receiving said hasp in said cavity, said side walls for enclosing the cavity at said sides, said latch for enclosing said opening to preclude access to the cavity through said opening with tampering tools; and at least one plate member for enclosing at least said bottom such that the side walls, said at least one plate member and the latch cooperate to enclose said cavity to preclude tampering access to said cavity and received shank by said tampering tools, said at least one plate member having a first aperture cooperating with said received at least one hasp aperture for receiving said shank therethrough, the locking means and locking body for locking the received hasp to the at least one plate member whereby said shank and received hasp between said locking means and said locking body are enclosed to preclude access to the shank by said tampering tools;

the shank having a U-shaped portion with a bight forming said locking means between said one end and said opposing end, said hasp at least one aperture for receiving said bight, said at least one plate member having at least one aperture for receiving the opposing shank end such that said bight is captured by said received hasp, the one end being unlocked relative to the locking body in the locked state, the locking body attached to the opposing end and bight cooperating with said at least one plate member and said hasp for locking the hasp to the at least one plate member.

3. The combination of claim 2 wherein said at least one plate member has a further aperture for receiving said shank one end.

4. The combination of claim 2 wherein the first aperture is enlarged relative to the shank to receive and engage a portion of said locking body.

5. The combination of claim 2 wherein the latch is for enclosing said cavity top.

6. A protection device for a bolt seal having a shank, a head and a locking body and for a latch hasp having a pair of alignable apertures for receiving the seal shank comprising:

a housing having a cavity and comprising front and rear walls, a pair of opposing lateral side walls, a top plate member and a bottom plate member, said rear wall having an opening for receiving said hasp, said received hasp for enclosing said opening, said walls and plate members for enclosing said cavity to preclude access by tampering tools to the hasp and to the shank in said cavity, said top and bottom plate members each having an aperture for receiving said shank between said head and locking body, said bolt seal for securing the hasp to and between said top and bottom plate members;

said bottom plate member comprising a V-shaped member with its apex closest to and facing in a direction toward said top plate member for forming a recess for receiving said locking body.

7. The device of claim 6 wherein certain of the housing walls cooperate with the bottom plate member for surrounding said recess and said received locking body.

8. A protection device for a bolt seal including a U-shaped shank having a bight and a locking body for releasable attachment to a shank end portion distal the bight and for a latch hasp having an aperture for receiving the shank bight comprising:

a housing having a cavity with a top formed by front and rear walls, a pair of opposing lateral side walls and a bottom plate member, said cavity at the top forming an opening for receiving said hasp, said latch for enclosing said opening, said walls, plate member and latch for enclosing said cavity to preclude access by tampering tools to the hasp and to the shank in said cavity, said bottom plate member having an aperture for receiving and passing therethrough said end portion for receiving said locking body in locking engagement;

said bottom plate member having a rear portion lying in a plane normal to said side, front and rear walls and a front portion lying in a plane inclined relative to said front and rear walls, each said rear and front portions having a corresponding aperture for receiving a different shank end.

9. The device of claim 8 wherein said bottom plate member receives a shank end distal the end portion.

10. The device of claim 8 wherein the rear wall and a portion of the side walls depend below the bottom plate member so as to form a protective recess for said locking body.

11. Protection device for a latch hasp having at least one aperture and a bolt seal comprising a shank and a head secured to the shank at one shank end and a locking body selectively locked to an opposing shank end for locking the hasp therebetween, said device comprising:

a housing including a plurality of side walls defining and enclosing the sides of a cavity having a bottom, a top and a plurality of sides, said housing having an opening in one of the side walls for receiving said hasp in said cavity;

a first plate member for enclosing said top and having a first aperture aligned with the received at least one hasp aperture;

a second plate member for enclosing said bottom and having a second aperture aligned with said first aperture and the received at least one hasp aperture; and a third plate member in said cavity intermediate said first and second plate members for further enclosing and dividing said cavity into a further cavity, said third plate member having a third aperture aligned with said first and second apertures and with the received at least one hasp aperture, all said apertures for receiving said shank therethrough, said first aperture being enlarged relative to said third aperture for receiving said head therethrough so that the received head is intermediate said first and third plate members, the head and locking body for locking the received hasp to the second and third plate members, the side walls, the second and third plate members and the latch cooperating to enclose said further cavity to preclude tampering access to said further cavity and received shank by said tampering tools.

12. The device of claim 11 wherein the third plate member third aperture for receiving a portion of the head so that said locked shank between said head and locking body is fully within said further cavity and enclosed.

13. The device of claim 11 wherein one of said side walls forms a rear wall, the wall opposite the rear wall forming a front wall, at least a portion of each of a plurality of said side walls for extending beyond said second plate member to form a partially enclosed region about the received locking body.

14. The device of claim 11 wherein the head and third plate member have complementary tapered surfaces.

15. The device of claim 11 wherein said side walls form a front and rear wall and a pair of opposing lateral side walls, said rear wall and at least a portion of the lateral side walls depending below said second plate member for forming a recess for shielding said locking body on three sides.

16. The device of claim 15 wherein said second plate member has a first section parallel to the third plate member connected to the lateral side walls and rear wall and a second section inclined relative to the third plate member and front wall and connected to the lateral side walls and front wall.

17. Protection device for a latch hasp and bolt seal, the hasp having at least one aperture, said seal comprising 1) a shank having opposing ends, said shank for passing through said at least one aperture, 2) locking means for precluding passage of one shank end in a locked state through said at least one aperture and 3) a locking body selectively locked to the shank at an opposing shank end for locking the hasp therebetween, said device comprising:

a housing including a plurality of side walls defining a cavity having a bottom, a top and a plurality of sides, said housing having an opening for receiving said hasp in said cavity, said side walls for enclosing the cavity at said sides, said latch for enclosing said opening to preclude access to the cavity through said opening with tampering tools; and at least one plate member for enclosing at least said bottom such that the side walls, said at least one plate member and the latch cooperate to enclose said cavity to preclude tampering access to said cavity and received shank by said tampering tools, said at least one plate member having a first aperture cooperating with said received at least one hasp aperture for receiving said shank therethrough, the locking means and locking body for locking the received hasp to the at least one plate member whereby said shank and received hasp between said locking means and said locking body are enclosed to preclude access to the shank by said tampering tools;

said at least one plate member comprising first and second plate members, one of said side walls forming a rear wall, said opening being in said rear wall, said first plate member for enclosing said cavity top and the second plate member for enclosing the cavity bottom, each said plate members having said first aperture for receiving the shank therethrough, the second plate member aperture being enlarged for receiving and engaging a portion of said locking body;

said second plate member being V-shaped with the apex of the V closest to the first plate member, the second plate member aperture being formed in said apex so that the second plate member and a portion of said side walls are coextensive forming a recess for receiving said locking body.

* * * * *